US005314792A

United States Patent [19]

Merrill

[11] Patent Number: 5,314,792

[45] Date of Patent: May 24, 1994

[54] PHOTOGRAPHIC ELEMENT AND PROCESS PROVIDING IMPROVED COLOR RENDITION

[75] Inventor: James P. Merrill, Rochester, N.Y.

[73] Assignee: Eastman Kodak Company, Rochester, N.Y.

[21] Appl. No.: 11,032

[22] Filed: Jan. 29, 1993

[51] Int. Cl.[5] ..... G03C 1/46

[52] U.S. Cl. ..... 430/505; 430/504; 430/506; 430/544; 430/957

[58] Field of Search ..... 430/505, 957, 544, 359, 430/382, 504, 506

[56] References Cited

U.S. PATENT DOCUMENTS 4,414,308 11/1983 Hamada ..... 430/505
4,782,012 11/1988 DeSelms et al. ..... 430/957
4,804,619 2/1989 Yamada et al. ..... 430/505
4,985,336 1/1991 Ichijima et al. ..... 430/544
5,006,448 4/1991 Szajewski et al. ..... 430/505

*Primary Examiner*—Charles L. Bowers, Jr.
*Assistant Examiner*—Geraldine Letscher
*Attorney, Agent, or Firm*—Arthur E. Kluegel

[57] ABSTRACT

A photographic element and process useful therewith comprises at least two light sensitive silver halide layers sensitized to green light and having differing degrees of light sensitivity, comprising in association with a higher sensitivity layer a yellow dye forming DIR coupler which releases a development inhibitor containing a weak inhibitor fragment, and further comprising in association with the lower sensitivity layer a cyan dye forming DIR coupler with a timing group containing a strong inhibitor fragment which releases a precursor of the development inhibitor fragment.

17 Claims, No Drawings

PHOTOGRAPHIC ELEMENT AND PROCESS PROVIDING IMPROVED COLOR RENDITION

FIELD OF THE INVENTION

This invention relates to color photographic elements and processes which produce improved color rendition.

BACKGROUND OF THE INVENTION

It has been desirable to improve the color rendition of photographic elements. More specifically, it is desirable to have the ability to inhibit the red- and the blue- sensitive layers to the desired degree as a function of green layer development.

One method for improved color reproduction is through the use of colored couplers as described in U.S. Pat. Nos. 4,163,670; 2,428,054; and 3,148,062. However, with this method of color correction, the nonexposed areas are highly colored which can lead to long printing times. Furthermore, in a multilayer structure where the layer arrangement is blue-sensitive, green-sensitive, and red-sensitive, with respect to the exposing light only a yellow colored coupler could be used in the green-sensitive layers or there would be a loss in red layer sensitivity.

The use of "DIR couplers" or "development inhibitor releasing" couplers as defined in C. R. Barr, J. R. Thirtle, and P. W. Vittum, *Photographic Science and Engineering*, Vol. 13, 74N, 80 214–217 (1969),are generally known to provide interlayer effects and improve color reproduction through the imagewise release of inhibitor fragments. There are generally two types of inhibitor fragments: inhibitor fragments which strongly adsorb to silver and greatly suppress development (strong inhibitors) and inhibitor fragments which weakly adsorb to silver and suppress development to a lesser degree (weak inhibitors). Both types of inhibitor fragments can be linked to the coupler through a timing group which allows the inhibitor precursor to diffuse. However, DIRs linked through a timing group to a pyrazolone nucleus are unstable and costly to manufacture. Therefore, there is a need to have DIR compounds in the green sensitive layers which overcome the existing deficiencies.

There have been numerous attempts to define layer arrangements incorporating DIRs of various types. For example, U.S. Pat. No. 4,804,619 discloses the use of diffusible DIRs in a highest green-sensitive layer of a specified layer thickness. The inhibitor fragment released from the DIR may be diffusible because of its weak inhibiting ability or may be linked through a timing group to permit it to diffuse. However, no particular combination of DIRs to be used in the fast and in the slower layers is disclosed.

U.S. Pat. No. 4,414,308 teaches the inclusion of a DIR with a timing group in the fast, the slow and/or an intermediate nonsensitive layer of a multilayer pack. No particular arrangement of layers nor combination of DIRs is suggested.

Other U.S. patents that deal with the use of DIRs in multilayer applications are the following: U.S. Pat. Nos. 4,963,465; 4,145,219; 4,273,861; 4,670,375; and 4,564,587. None of the disclosed arrangements provide the desired effect of green light on the red and blue records so as to improve the color rendition sufficiently.

It is therefore a problem to be solved to provide a photographic element and process which provide improved color rendition through the ability to inhibit the red- and blue-sensitive layers to the desired degree as a function of the development of the green-sensitive layers through the incorporation of a specified combination of DIRs.

SUMMARY OF THE INVENTION

A photographic element and process useful therewith comprises at least two light sensitive silver halide layers sensitized to green light and having differing degrees of light sensitivity, comprising in association with a higher sensitivity layer a yellow dye forming DIR coupler which releases a development inhibitor containing a weak inhibitor fragment, and further comprising in association with the lower sensitivity layer a cyan dye forming DIR coupler with a timing group containing a strong inhibitor fragment which releases a precursor of the development inhibitor fragment.

This layer arrangement provides the ability to inhibit the red- and the blue-sensitive layers to the desired degree as a function of the green-sensitive layer development and and thereby provides improved color rendition.

DETAILED DESCRIPTION OF THE INVENTION

The element of the present invention is comprised of a highly green-sensitive layer containing a yellow dye-forming development inhibitor releasing (DIR) couple which releases a weak inhibitor and a lower green sensitive layer containing a cyan dye forming DIR coupler having a timing group which releases a strong inhibitor.

The coupler containing the weak inhibitor fragment forms a yellow dye upon coupling. This has the effect of offsetting the inhibiting effect that this inhibitor might have on the blue sensitive layer. Thus, the inhibiting effect on the formation of yellow dye in the blue-sensitive layer is offset by the increased formation of yellow dye in the green-sensitive layer. The fact that the inhibitor is weak serves to minimize the inhibiting effect on the green-sensitive layer from which the DIR is released and this helps to minimize the adverse effect on green speed.

In a similar manner, the coupler containing the strong inhibitor with the timing group forms a cyan dye upon coupling. This cyan dye helps offset the inhibition of the formation of cyan dye in the red-sensitive layer as a result of the release of inhibitor in the green-sensitive layer.

The presence of the timing group in conjunction with the strong inhibitor helps to minimize the inhibiting effect in the green-sensitive layer where it is released as a precursor which is not itself inhibiting. The precursor is thus free to migrate from the layer in which it was released.

Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat.

Nos. 2,600,788, 2,369,489, 2,343,703, 2,311,082, 3,152,896, 3,519,429, 3,062,653, 2,908,573 and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961). Such couplers are typically open chain ketomethylene compounds.

The method for evaluating the inhibitor strength of an inhibitor releasing coupler is well known in the art. See for example U.S. Pat. No. 5,006,448. In the present invention, DIRs containing inhibitor fragments with I.S. values of 50 or more are classified as strong inhibitors and those having such values less than 50 are classified as weak inhibitors.

Development inhibitors are generally released imagewise from an incorporated DIR compound during processing of the exposed photographic element. To evaluate the intrinsic inhibition strength of such inhibitors, independent of DIR release, an imbibition test is used. This involves imbibing an exposed film strip with a solution containing a given concentration of the free inhibitor to be tested. Nitrogen burst agitation of the imbibing solution improves the repeatability and effectiveness of inhibitor incorporation. The measured strength obtained by this test serves as an important guide in selecting inhibitors for desired photographic acutance and color rendition improvements.

Film samples for imbibition testing of inhibitors were prepared having the following schematic layer structure and using a silver bromoiodide emulsion containing 6.4 mole % iodide(numerical values denote coating coverages in $mg/m^2$ and the silver halide values are for equivalent weights of silver):

Overcoat: Gelatin - 2691; Bis(vinlylsulfonylmethyl) ether hardener at 1.75% by weight of total gelatin Cyan Layer: Gelatin - 2691; Green-sensitized AgBrI 1615; Cyan dye forming coupler (C-1) 753

Film Support: Poly(ethylene terephthalate)

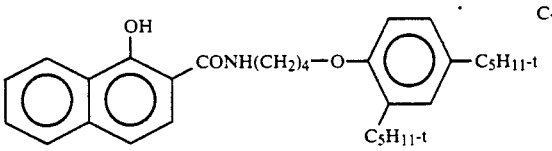

C-1

Film strips cut from this coated element were exposed through a graduated-density test object and a Kodak Wratten 99 (green) filter. Before development a strip was immersed at 38° C. under nitrogen agitation in each of the separate prebaths containing a test inhibitor at $5\times10^{-5}$M concentration in a pH 10 carbonate buffer plus 0.1% dimethylformamide. As controls, each test set included a check strip which was immersed in a prebath containing no inhibitor and strips immersed in prebaths containing the comparison inhibitors phenylmercaptotetrazole (CI-1) and ethylmercaptotetrazole (CI-2). Photographic processing was carried out at 38° C. in the following steps:

| | |
|---|---|
| Inhibitor prebath | 2 min |
| Developer[1] | 2.75 min |
| Stop | 2 min |
| Wash | 2 min |
| Bleach | 2 min |
| Wash | 2 min |
| Fix | 2 min |
| Wash | 2 min |

[1]The developer used in the test was as follows:

Developer

| | grams/liter |
|---|---|
| $K_2SO_3$ | 2.0 |
| 4-amino-3-methyl-N-ethyl-beta-hydroxyethylaniline sulfate | 3.35 |
| $K_2CO_3$ | 30.0 |
| KBr | 1.25 |
| KI | 0.0006 |
| adjust to pH = 10.0 | |

Red light densitometric curves were plotted for each strip and an exposure step at which the no-inhibitor check showed a density close to 1.0 above fog was selected. The density of each test strip at this same exposure was noted and the inhibition strength number (I.S. No.) calculated using the equation:

$$\frac{(\text{Density of check} - \text{density of test})}{\text{Density of check}} \times 100$$

Larger I.S. numbers for given inhibitors indicate stronger inhibition resulting in less dye density formed.

The preferred weak inhibitors of the invention are the benzotriazoles and alkylmercaptotetrazoles. Table I shows typical examples of weak inhibitors and their corresponding I.S. numbers.

TALBE I

Weak Inhibitors and I.S. Numbers

| Inhibitor | I.S. | Inhibitor | I.S. |
|---|---|---|---|
| 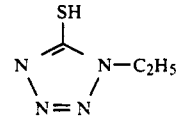 | 15 | 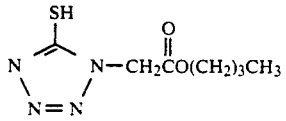 | 28 |
| 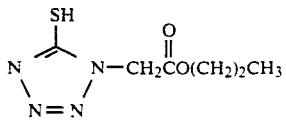 | 30 | 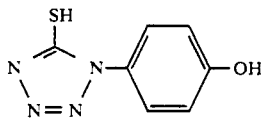 | 48 |

TALBE I-continued

| Weak Inhibitors and I.S. Numbers | | | |
|---|---|---|---|
| Inhibitor | I.S. | Inhibitor | I.S. |
| 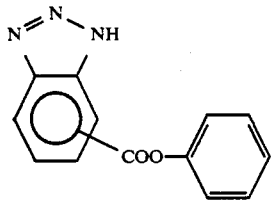 | 40 | 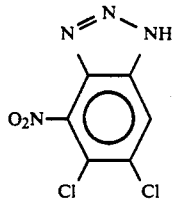 | 45 |

The strong inhibitors of the invention are preferably aryl and arylalkyl mercaptotetrazoles and aryl oxadiazoles. Suitable examples of the strong inhibitors and their corresponding I.S. numbers are as shown in Table II.

TABLE II

| Strong Inhibitors and I.S. Numbers | | | |
|---|---|---|---|
| Inhibitor | I.S. | Inhibitor | I.S. |
| 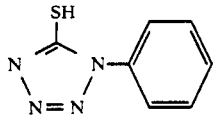 | 80 | 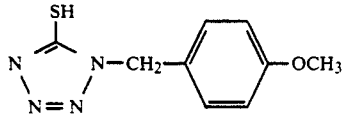 | 82 |
| 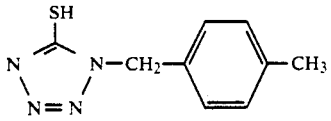 | 61 | 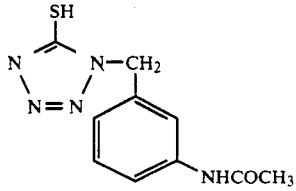 | 82 |
| 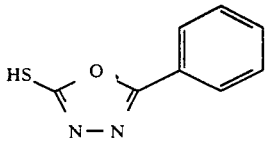 | 89 | | |

Further examples of DIRs having weak and strong inhibitor groups are shown, for example, in U.S. Pat. No. 5,006,448.

The DIR in the green layer of lower sensitivity in the invention includes a timing group in addition to having a strong inhibitor. The timing group is joined to the coupler moiety at any of the positions from which groups released from couplers by reaction with oxidized color developing agent can be attached. Preferably, the timing group is attached at the coupling position of the coupler moiety so that upon reaction of the coupler with oxidized color developing agent the timing group will be displaced. However, the timing group can be attached to a non-coupling position of the coupler moiety from which it will be displaced as a result of reaction of the coupler with oxidized color developing agent. In the case where the timing group is at a non-coupling position of the coupler moiety, other groups can be in the coupling position, including conventional coupling-off groups or the same or different inhibitor fragments or precursors from that described in the invention. Alternatively, the coupler moiety can have a timing group at each of the coupling position and a non-coupling position. Accordingly, couplers of this invention can release more than one mole of inhibitor or other photographically useful material per mole of coupler. These released fragments can be the same or different and can be released at the same or different times and rates.

The timing group can be any organic group that will serve to connect the coupler to the inhibitor fragment or precursor moiety and which, after cleavage from the coupler, will cleave from the inhibitor moiety preferably by an intramolecular nucleophilic displacement reaction of the type described in, for example, U.S. Pat. No. 4,248,962 or by electron transfer down a conjugated chain as described in, for example, U.S. Pat. No. 4,409,323 (quinone-methide types), the disclosures of which are incorporated herein by reference. Timing groups utilizing the mechanism in which there is electron transfer down a conjugated chain are especially preferred. U.S. Pat. Nos. 4,842,994 and 5,135,839 contain a detailed explanation of timing groups which may be suitable for use in the invention.

The term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have a nucleophilic group and an electrophilic group spatially related by the configuration of the molecule to promote reactive proximity. Preferably the nucleophilic group and the electrophilic group are located in the compound so that a cyclic organic ring, or a transient cyclic organic ring, can be easily formed by an intramolecular reaction involving the nucleophilic center and the electrophilic center.

A useful illustrative class of timing group (T) is represented by the structure:

-(Nu - X - E)- wherein:

Nu is a nucleophilic group attached to a position on the coupler from which it will be displaced upon reaction of the coupler with oxidized color developing agent, E is an electrophilic group attached to the inhibitor fragment as described and is displaceable therefrom by Nu after Nu is displaced from the coupler; and X is a linking group for spatially relating Nu and E, upon displacement of Nu from the coupler, to undergo an intramolecular nucleophilic displacement reaction with the formation of a 3- to 7 (preferably 5- or 6-) -membered ring and thereby release the inhibitor fragment.

A nucleophilic group (Nu) is understood to be a grouping of atoms wherein one of which is electron rich. This atom is referred to as the nucleophilic center. An electrophilic group (E) is understood to be a grouping of atoms wherein one of which is electron deficient. This atom is referred to as the electrophilic center.

In photographic couplers as described, the timing group can contain a nucleophilic group and an electrophilic group that are spatially related with respect to one another by a linking group so that upon release from the coupler moiety, the nucleophilic center and the electrophilic center will react to effect displacement of the inhibitor moiety from the timing group. The nucleophilic center should be prevented from reacting with the electrophilic center until release from the coupler moiety and the electrophilic center should be resistant to external attack such as hydrolysis. Premature reaction can be prevented by attaching the coupler moiety to the timing group at the nucleophilic center or at an atom in conjunction with a nucleophilic center, so that cleavage of the timing group and the inhibitor moiety from the coupler moiety unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups , or precursors thereof, which may remain attached to the timing group or be released.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

Especially preferred are those timing groups having the structure:

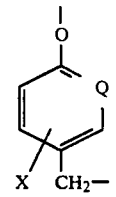

wherein X is hydrogen or one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido and sulfonamide; and Q is —N= or —C(W)=; wherein W is an electron donating group characterized by a sigma-para value greater than 0 (as determined as described in , *Journal of Medicinal Chemistry*, Hansch and Leo, 16, 1207, (1973). Typical W groups are $—NO_2$, $—NHSO_2CH_3$, $—NHSO_2C_{16}H_{33}$, $—NHCOCH_3$, $—NHCOC_{11}H_{23}$, —Cl, —Br, $—OCH_3$, $—OCH_2CH_2OCH_3$, etc. Other useful timing groups are described in U.S. Pat. Nos. 4,737,451; 4,546,073; 4,564,587; 4,618,571; 4,698,297 and European Published Patent Applications 167,168A, 255,085A, and 362,870A.

The timing group can contain moieties and substituents that will permit control of one or more of the rates of reaction of the coupler with oxidized color developing agent, the rate of diffusion of the inhibitor fragment once it is released from the coupler, and the rate of release of the inhibitor. The timing group can contain added substituents, such as added photographically useful groups, that can remain attached to the timing group and be released independently. The timing groups can contain a ballast group.

In a preferred embodiment of the invention, one or more of the green-sensitive layers contains a yellow colored magenta dye-forming masking coupler. Any coupler known for this purpose may be employed. The use of 4-arylazopyrazolone masking couplers is known in the art. See, for example, U.S. Pat. Nos. 2,455,170; 2,428,034; 2,808,329; 2,434,272; 2,704,711; 2,688,539; 3,796,574; 3,476,560; 4,427,763; EP 213,490; and U.S. Pat. No. 4,777,123 as well as the materials referenced in *Research Disclosure* December 1989, Section VII, Part G, Published by Kenneth Mason Publications, Ltd., Dudley Annex, 12A North Street, Emworth, Hampshire PO10 7DQ, England. These compounds have proven useful since they are yellow colored in nonexposed areas and magenta colored in exposed areas. Thus, while the magenta dye formed in a color negative photographic process has a small but significant unwanted absorption in the blue range, this may be balanced somewhat by the relative loss of blue absorption due to conversion of the mask color from yellow to magenta in the exposed areas. Then, an adjustment can be made to the spectral content of the light used to produce the positive from the negative to effectively cancel out the unwanted blue absorption which has become essentially constant across both the exposed and unexposed areas of the negative.

In addition to MM-1 used in the examples and identified at the end of the examples, the following are examples of suitable masking couplers:

MM-2
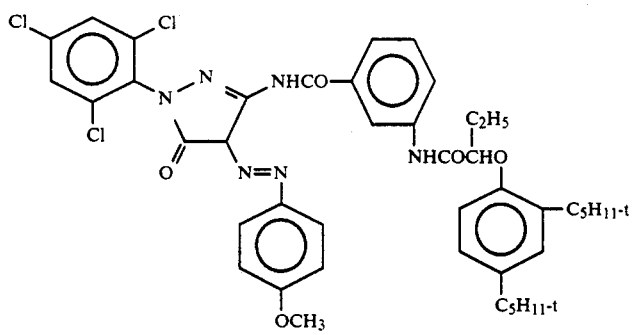
MM-3
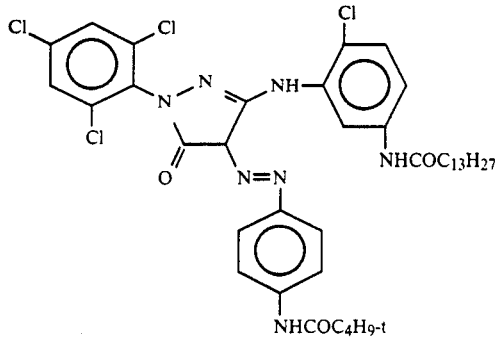
MM-4
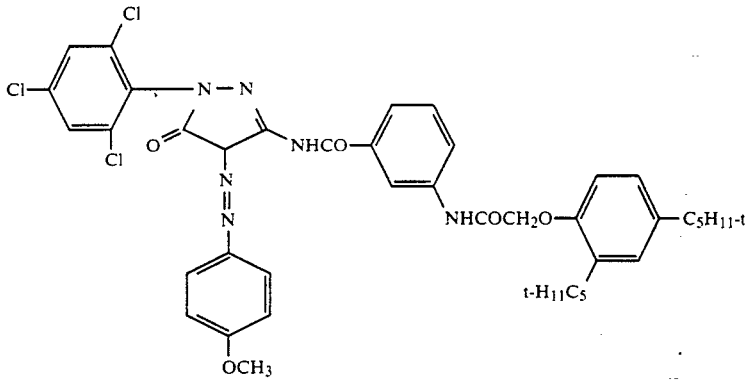
MM-5
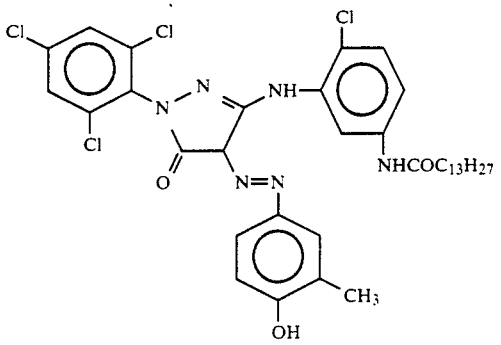

-continued

MM-6

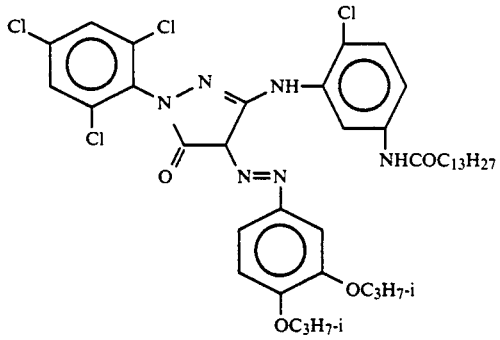

MM-7

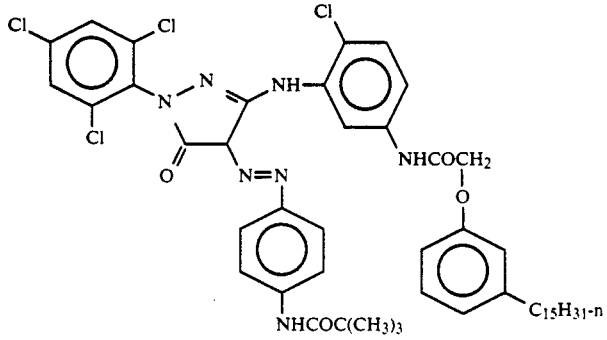

MM-8

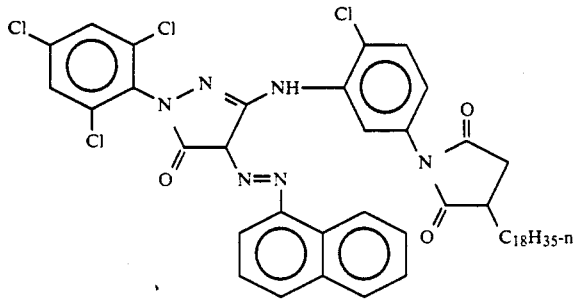

The present invention has beneficial effects on color rendition where a two-layer green sensitive pack is employed but the best results are obtainable with the use of a three-layer green-sensitive pack or "triple coat". In such case, it is preferred to employ the weak inhibitor DIR in the high green-sensitive layer and the strong inhibitor DIR with a timing group in the mid-sensitivity layer.

The materials of the invention can be used in any of the ways and in any of the combinations in which such materials are used in the photographic art. Typically, they are incorporated in a silver halide emulsion or emulsions and then coated on a support to form part of a photographic element. Alternatively, they can be incorporated at a location adjacent to the silver halide emulsion where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

The photographic elements are multicolor elements which contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND.

In the following discussion of suitable materials for use in the emulsions and elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

It may be useful to use a combination of couplers any of which may contain known ballasts or coupling-off groups such as those described in U.S. Pat. Nos. 4,301,235; 4,853,319 and U.S. Pat. No. 4,351,897. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

For example, the materials of the invention may be included in the green-sensitive layers in a color negative photographic element comprising a support bearing the following layers from top to bottom:

(1) one or more overcoat layers containing ultraviolet absorber(s);

(2) a double-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl-)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5- [(2,2,3,3,4,4,4-heptafluoro-1-oxobutyl)amino]-4-hydroxyphenoxy]- 2,3-dihydroxy-6-[(propylamino)carbonyl phenyl]thio]-1,3,4-thiadiazol-2-yl]thio]-, methyl est and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4bis(1,1-dimethylpropyl)phenoxy)-1-oxobutyl-)amino)-N(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4′, 5′-dihydro-5′-oxo-1′-(2,4,6-trichlorophenyl) (1,4′-bi-1H-pyrazol)-3′-yl)-, "Coupler 6": Carbamic acid, (6-(((3-(dodecyloxy)propyl) amino)carbonyl)-5-hydroxy-1-naphthalenyl)-, 2-methylpropyl ester , "Coupler 7": Acetic acid, ((2-((3-(((3-(dodecyloxy)propyl-)amino) carbonyl)-4-hydroxy-8-(((2-methylpropoxy)-carbonyl) amino)-1-naphthalenyl)oxy )ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)-phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The compositions may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The materials of the invention may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No.5,019,492.

The invention materials may further be used in combination with image-modifying compounds other than those detailed herein. DIR's useful in conjunction with the materials of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

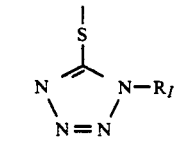

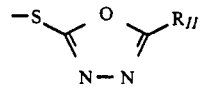

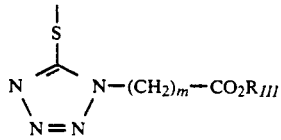

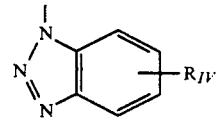

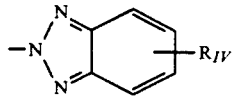

wherein $R_I$ is selected from the group consisting of straight and branched alkyls of from 1 to about 8 carbon atoms, benzyl and phenyl groups and, optionally, said groups containing one or maorealkoxy substituents; $R_{II}$ is selected from $R_I$ and $-SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $-COOF_V$ and $-NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

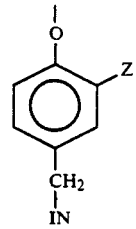

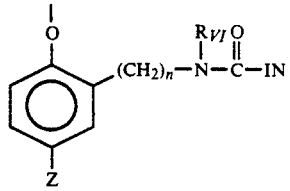

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

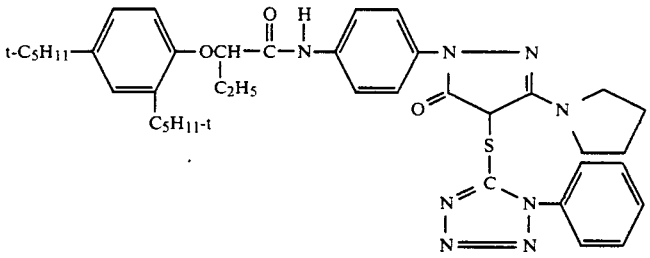

D2

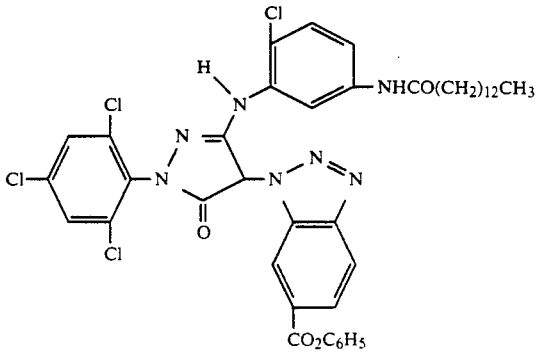

-continued
D3
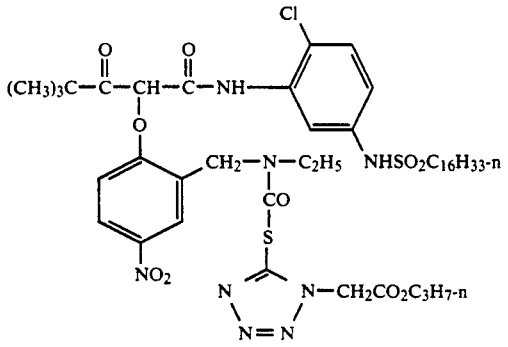
D4
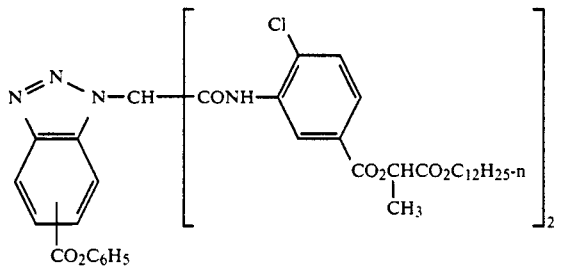
D5
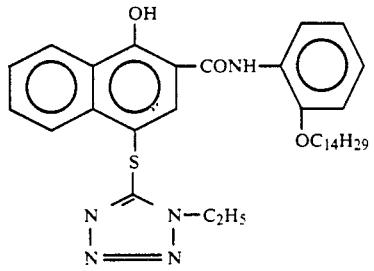
D6
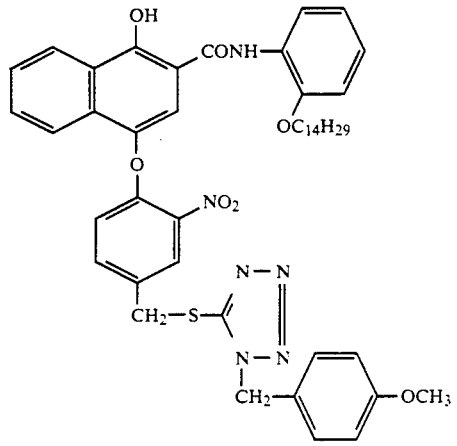

-continued

D7

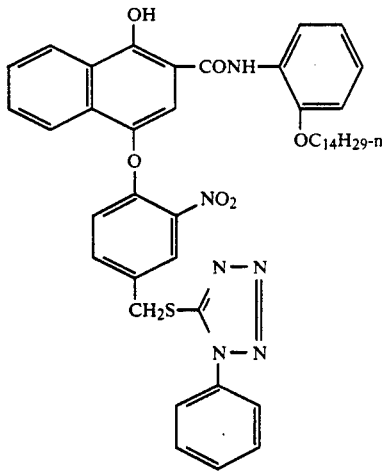

D8

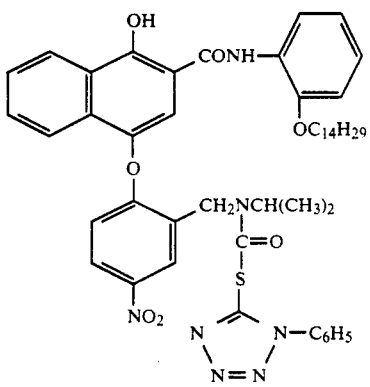

Especially useful in this invention are tabular grain silver halide emulsions. Specifically contemplated tabular grain emulsions are shot in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T = ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 49914,014; 4,962,015; 4,985,350; 5,061,069 and 5,061,616.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1982, pages 209–211 and 1988, pages 191–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(*b*-(methanesulfonamido) ethyl)aniline sesquisulfate hydrate,
4-amino-3-methyl N-ethyl-N-(*b*-hydroxyethyl)aniline sulfate,
4-amino-3-b-(methanesulfonamido)ethyl-N,N-diethylaniline hydrochloride and
4-amino-N-ethyl-N-(2-methoxyethyl)-*m*-toluidine di-*p*-toluene sulfonic acid.

Development is usually followed by the conventional steps of bleaching, fixing, or bleach-fixing, to remove silver or silver halide, washing, and drying.

It is understood throughout this specification and claims that any reference to a substituent by the identification of a group containing a substitutable hydrogen (eg alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

EXAMPLES

The following example will serve to illustrate the invention further. The formulas for the component materials are provided following the example.

PHOTOGRAPHIC EXAMPLE 1

A color photographic recording material (Photographic Sample 101) for color negative development was prepared by applying the following layers in the given sequence to a transparent support of cellulose triacetate. The quantities of silver halide are given in grams of silver per $m^2$. The quantities of other materials are given in grams per $m^2$.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average grain thickness 0.08 microns] at 0.22 g, red sensitized silver iodobromide emulsion [4 mol % iodide, average grain diameter 1.0 microns, average grain thickness 0.09 microns] at 0.33 g, cyan dye-forming image coupler C-1 at 0.56 g, BAR compound B-1 at 0.089 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.56 g, cyan dye-forming image coupler C-1 at 0.23 g, cyan dye-forming forming masking coupler CM-1 at 0.022 g, DIR compound D-2 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.22 g, cyan dye-forming image coupler C-1 at 0.18 g, cyan dye-forming masking coupler CM-1 at 0.050 g, DIR compound D-6 at 0.003 g, DIR compound D-2 at 0.050 g, with gelatin at 1.36 g.

Layer 5 {Interlayer} Yellow dye material YD-1 at 0.11 g and 1.33 g of gelatin

Layer 6 {First (least) Green-sensitive Layer} Green sensitized silver iodobromide emulsion [4 mol iodide, average grain diameter 1.0 microns, average grain thickness 0.09 microns] at 0.78 g, magenta dye-forming image coupler M-2 at 0.22 g, magenta dye-forming image coupler M-3 at 0.089 g with gelatin at 1.78 g.

Layer 7 {Second (more) Green-Sensitive Layer} Green sensitized silver iodobromide emulsion [4 mol iodide, average grain diameter 1.25 microns, average grain thickness 0.12 microns] at 1.00 g, magenta dye-forming image coupler M-2 at 0.089 g, magenta dye-forming image coupler M-3 at 0.028 g, magenta dye-forming masking coupler MM-1 at 0.089 g with gelatin at 1.48 g.

Layer 8 {Third (most) Green-Sensitive Layer} Green sensitized silver iodobromide emulsion [4 mol iodide, average grain diameter 2.16 microns, average grain thickness 0.12 microns] at 1.00 g, magenta dye-forming image coupler M-2 at 0.089 g, magenta dye-forming image coupler M-3 at 0.028 g, magenta dye-forming masking coupler MM-1 at 0.044 g, DIR compound D-3 at 0.008, DIR compound D-4 at 0.008 g with gelatin at 1.33 g.

Layer 9 {Interlaver} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55 microns, average grain thickness 0.08 microns] at 0.11 g, blue sensitized silver iodobromide emulsion [4 mol % iodide, average grain diameter 1.25 microns, average grain thickness 0.12] at 0.26 g, blue sensitized silver iodobromide emulsion [6 mol % iodide, average grain diameter 1.0 microns, average grain thickness 0.26 microns] at 0.26 g, yellow dye forming image coupler Y-2 at 0.94 g, DIR compound D-5 at 0.049 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.39 g, blue sensitized silver iodobromide emulsion [9 mol % iodide, average grain diameter 1.0] at 0.39 g, yellow dye-forming image coupler Y-2 at 0.28 g, DIR compound D-5 at 0.044 g, BAR compound B-1 at 0.006 g with gelatin at 1.97 g.

Layer 12 {Protective Layer} 0.106 g of dye UV-1, 0.106 g of dye UV-2, unsensitized silver bromide Lippman emulsion at 0.222 g, 2.03 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Sample 102 was prepared like Photographic Sample 101 except DIR compound D-4 was added to layer 7 at 0.011 g.

Photographic Sample 103 was prepared like Photographic Sample 101 except DIR compound D-4 was added to layer 7 at 0.022 g.

Photographic Sample 104 was prepared like Photographic Sample 101 except DIR compound D-1 was added to layer 7 at 0.009 g.

Photographic Sample 105 was prepared like Photographic Sample 101 except DIR compound D-1 was added to layer 7 at 0.018 g.

Photographic Sample 106 was prepared like Photographic Sample 101 except DIR compound D-1 was added to layer 7 at 0.027 g.

TABLE III

DIR Variation In the Mid-Green Sensitive Layer With Weak DIR in Most Green-Sensitive Layer

| Sample | Type | Coupler in mid-green | Level ($g/m^2$) | $R_r/R_n$ | $G_g/G_n$ | $B_b/B_n$ |
|---|---|---|---|---|---|---|
| 101 | Comp | None | 0 | 1.14 | 1.73 | 1.38 |
| 102 | Comp | D-4 | 0.011 | 1.20 | 1.69 | 1.38 |
| 103 | Comp | D-4 | 0.022 | 1.26 | 1.78 | 1.38 |
| 101 | Comp | None | 0 | 1.14 | 1.73 | 1.38 |
| 104 | Inv | D-1 | 0.009 | 1.16 | 1.74 | 1.46 |
| 105 | Inv | D-1 | 0.018 | 1.18 | 1.78 | 1.56 |
| 106 | Inv | D-1 | 0.027 | 1.18 | 1.77 | 1.61 |

a) $R_r/R_n$ — red separation gamma divided by red neutral gamma.
b) $G_g/G_n$ — green separation gamma divided by green neutral gamma.
c) $B_b/B_n$ — blue separation gamma divided by blue neutral gamma The controlling principal of the data is that a neutral exposure will cause exposure and development of the adjacent color records. This, in turn, will allow the adjacent records to release inhibitor which can migrate to the record of interest and thereby inhibit the development in the layer of interest. The gamma of the color of interest is therefore suppressed. By comparison, exposure of the element to a monochrome which affects only one color record will not cause the release of the inhibitors in adjacent records, and thus the monochrome exposure represents a noninhibited mode from an inter-image standpoint. Without inhibition, the ratio would be one. With increasing inhibition due to inter-image effects, the ratio increases due to the reduction in neutral gamma.

As shown by the photographic data presented in Table III, the photographic samples incorporating weak inhibitor DIR compound D-4 in the most green-sensitive layer and containing the same weak inhibitor DIR compound in the lower sensitive layer exhibit increased inhibition of the red record without any significant increase in the inhibition of the blue record. This combination does not achieve the desired inhibition effect on the blue record. On the other hand, the photographic samples incorporating the strong inhibitor DIR containing a timing group, compound D-1, in the lower green-sensitive layer exhibit had the effect of increasing blue inhibition as a result of green exposure while maintaining the red inhibition. This is the desired objective.

PHOTOGRAPHIC EXAMPLE 2

A color photographic recording material (Photographic Sample 107) for color negative development was prepared by applying the following layers in the given sequence to a transparent support of cellulose triacetate. The quantities of silver halide are given in g of silver per $m^2$. The quantities of other materials are given in g per $m^2$.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin

Layer 6 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer } Green sensitized silver iodobromide emulsion [4 mol iodide, average grain diameter 1.25 microns, average grain thickness 0.12 microns] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 8 {Third (most) Green-Sensitive Layer} Green seniitized silver iodobromide emulsion [4 mol % iodide, average grain diameter 2.16 microns, average grain thickness 0.12 microns] at 1.00 g, magenta dye-forming image coupler M-1 at 0.0.72 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye forming image coupler Y-1 at 0.090 g, yellow dye-forming image coupler Y-2 at 0.23 g, cyan dye-forming image coupler C-1 0.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsensitized silver bromide Lippman emulsion at 0.222 g, 2.03 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Sample 108 was prepared like Photographic Sample 107 except layer 8 had a level of magenta dye-forming masking coupler of 0.028 g.

Photographic Sample 109 was prepared like Photographic Sample 107 except layer 7 had a level of magenta dye-forming masking coupler of 0.033 g.

Photohgraphic Sample 110 was prepared like Photographic Sample 107 except layer 6 had a level of magenta dye-forming masking coupler of 0.033 g.

Tests were conducted to reveal the effect of the inclusion or absence of a yellow-colored magenta masking coupler on the ability of this combination with the couplers of the invention to effect the desired effect on the blue sensitive layer. These results are shown in Table II.

TABLE IV

Effect of Yellow-Colored Magenta Dye-Forming Masking Coupler

| Sample | Layers Containing Mask* | Lower $B_b/B_n$ | Mid $B_b/B_n$ | Mid Upper $B_b/B_n$ |
|---|---|---|---|---|
| 107 | H,M,L | 1.10 | 1.53 | 1.33 |
| 108 | M,L | 1.06 | 1.46 | 1.33 |
| 109 | H,L | 1.12 | 1.44 | 1.25 |
| 110 | H,M | 1.12 | 1.49 | 1.21 |

a) Low $B_b/B_n$ — blue separation gamma divided by blue neutral gammaa between Dmin+0.15 density and 0.4 logE slow of that point.
b) Mid $B_b/B_n$ — blue separation gamma divided by blue neutral gammab between 0.40 logE slow of Dmin+0.15 density and 1.1 logE slow of Dmin+0.15 density.
c) Mid Upper $B_b/B_n$ — blue separation gamma divided by blue neutral gammab between 1.1 logE slow of Dmin+0.15 density and 1.8 logE slow of Dmin+0.15 density.
*H — High Sensitivity; M — Mid Sensitivity; L — Low Sensitivity As demonstrated by the photographic data presented in Table IV, by employing the DIR couplers of the invention and also distributing a masking coupler in the most, mid, and least green-sensitive silver halide emulsion layers, the interimage effect of blue inhibition as a result of green exposure can be controlled throughout the desired exposure region to improve color rendition.

In reviewing all the data, it is apparent that an untimed yellow dye-forming DIR coupler which releases a weak inhibitor fragment, such as D-4, can be used in the more green-sensitive silver halide emulsion layer to control red inhibition, and a cyan dye-forming DIR coupler with a timing group and containing a strong inhibitor fragment, such as D-1, can be used in the lower green-sensitive silver halide emulsion layer to control blue inhibition. Further, a masking coupler, such as MM-1, can be distributed in one or more of the green-sensitive silver halide emulsion layers to balance the interimage inhibition of blue as a result of green exposure over the desired exposure region.

The formulas for the component materials are as follows:

C-1:

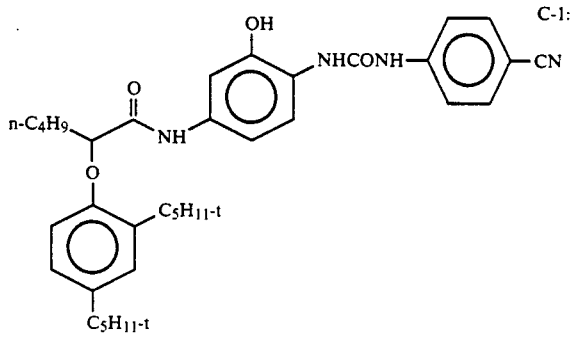

CM-1

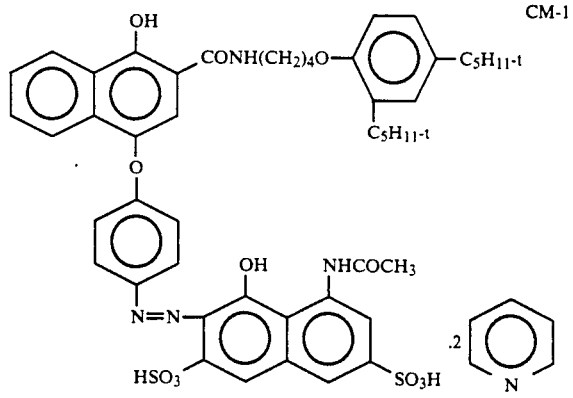

B-1

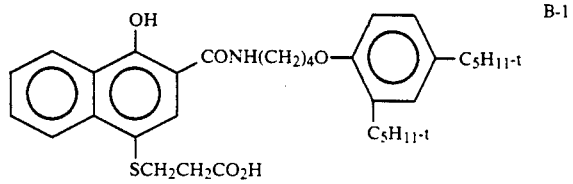

-continued
D-1:
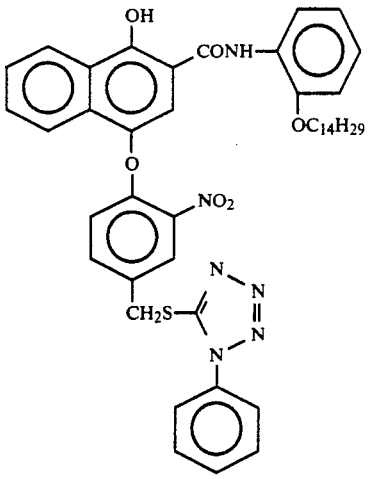
D-2
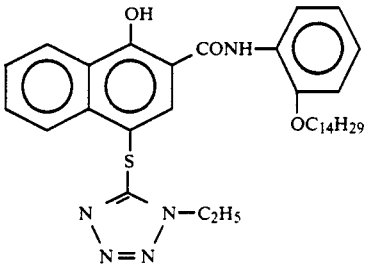
D-3:
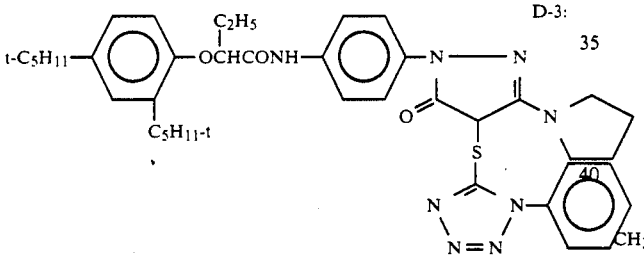
D-4
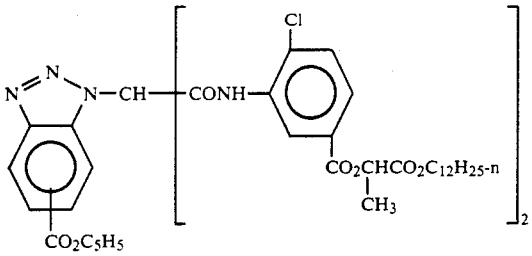
D-5:
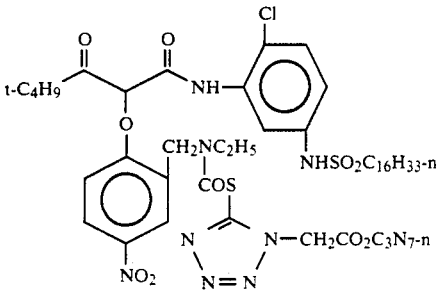
-continued
D-6:
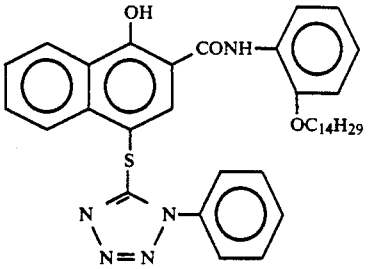
MM-1
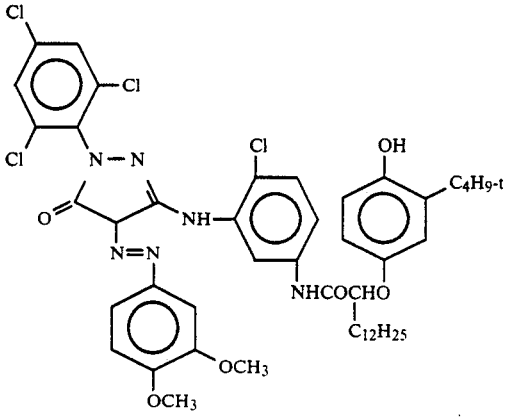
Y-1:
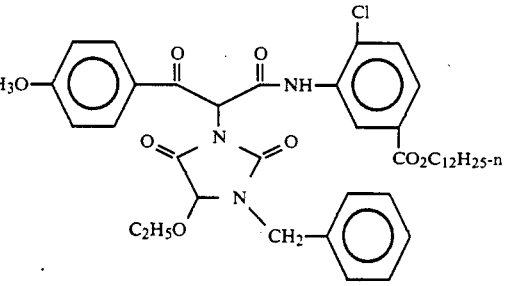
Y-2:
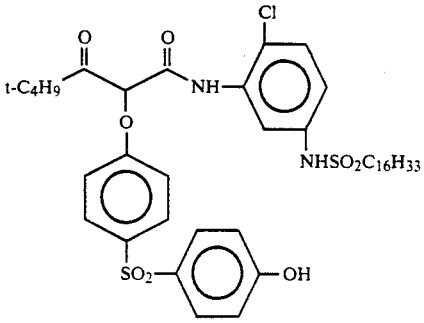

-continued

M-1:

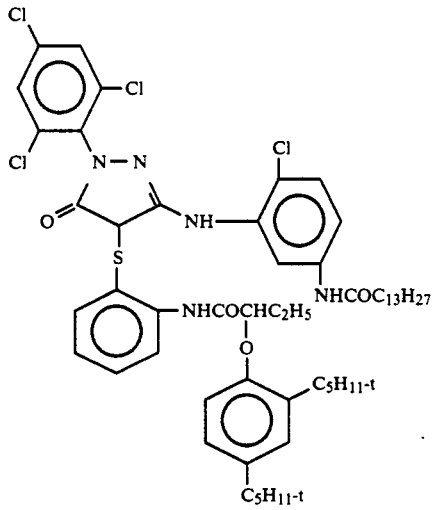

M-2:

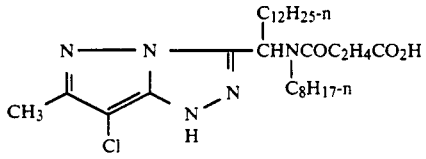

M-3:

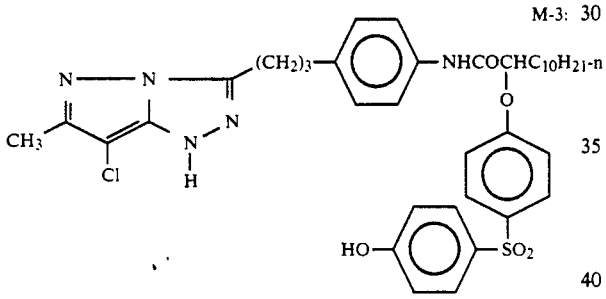

YD-1:

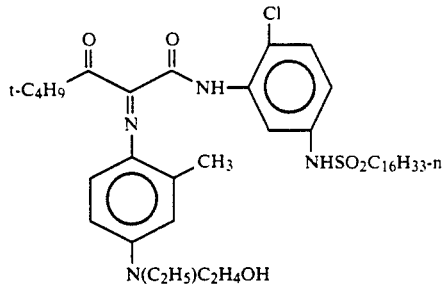

YD-2:

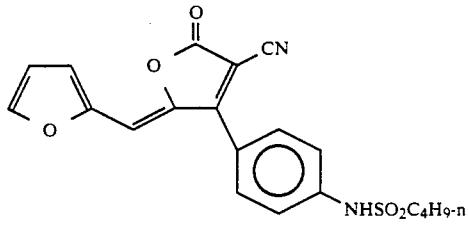

UV-1:

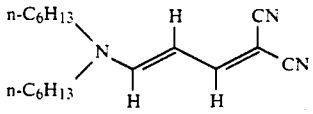

-continued

UV-2:

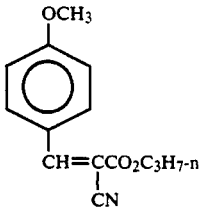

H-1:

$CH_2(SO_2CH{=}CH_2)_2$

What is claimed is:

1. A photographic element comprising at least two light sensitive silver halide layers sensitized to green light and having differeing degrees of light sensitivity, comprsing in association with a higher sensitivity layer a yellow dye forming DIR coupler which releases a development inhibitor containing a weak inhibitor fragment, and further comprising in association with the lower sensitivity layer a cyan dye forming DIR coupler with a timing group containing a strong inhibitor fragment which releases a precursor of the development inhibitor fragment.

2. The element of claim 1 wherein the DIR coupler which releases a development inhibitor containing a weak inhibitor fragment has a structure selected from the following:

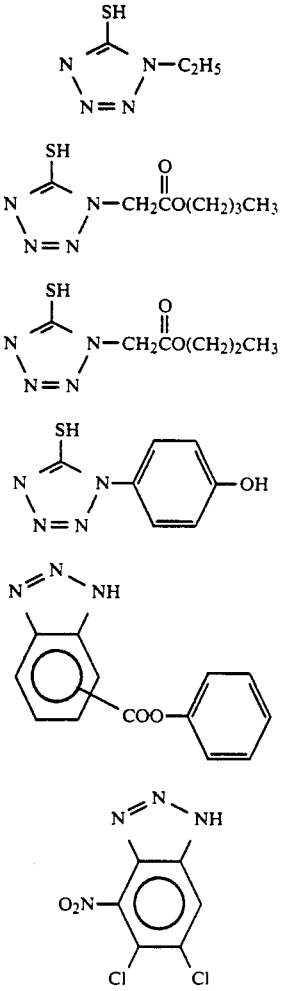

3. The element of claim 1 wherein the DIR coupler with a timing group containing a strong inhibitor fragment which releases a precursor of the development inhibitor fragment contains an inhibitor fragment selected from the group consisting of the following:

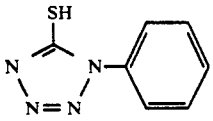

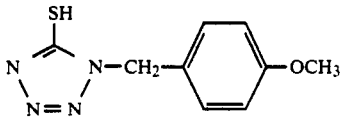

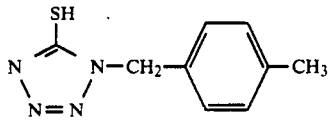

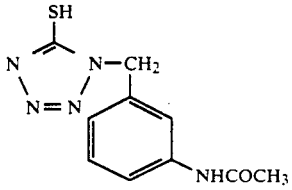

-continued

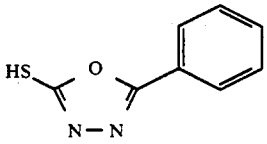

4. The element of claim 1 wherein the weak inhibitor fragment is selected from the group consisting of benzotriazole and alkylmercaptotetrazole.

5. The element of claim 1 wherein the strong inhibitor fragment is a phenylmercaptotetrazole.

6. The element of claim 1 wherein the DIR coupler with a timing group containing a strong inhibitor fragment which releases a precursor of the development inhibitor fragment contains a quinone methide timing group.

7. The element of claim 1 wherein the yellow-dye forming DIR coupler is an open chain ketomethylene compound.

8. The element of claim 1 wherein the cyan dye forming DIR coupler is a phenolic or naphtholic compound.

9. The element of claim 1 wherein the photographic element contains at least three layers sensitized to green light and having different light sensitivities.

10. The element of claim 7 wherein the higher sensitivity layer containing the yellow dye-forming DIR coupler is the most green sensitive layer.

11. The element of claim 8 wherein the lower sensitivity layer containing the cyan dye-forming DIR coupler is the mid green-sensitive layer.

12. The element of claim 1 containing a yellow colored magneta dye-forming masking coupler in at least one of said green sensitive layers.

13. The element of claim 12 wherein the masking coupler is selected from the following:

MM-1

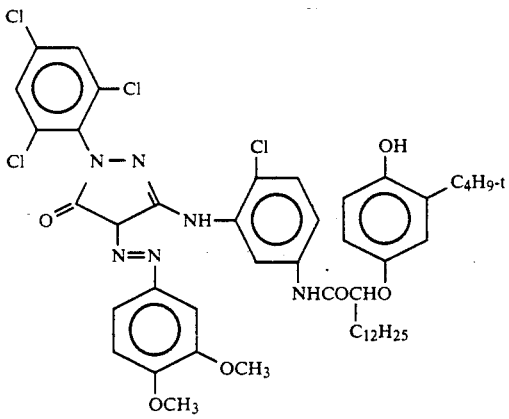

MM-2

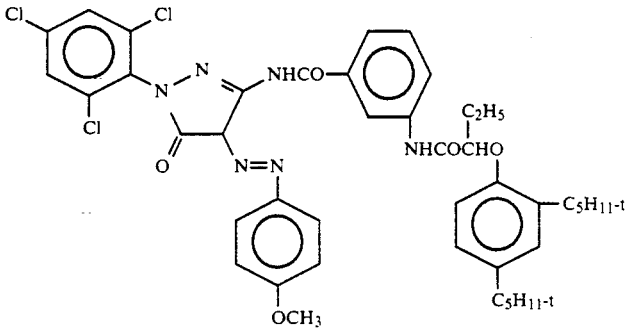

-continued
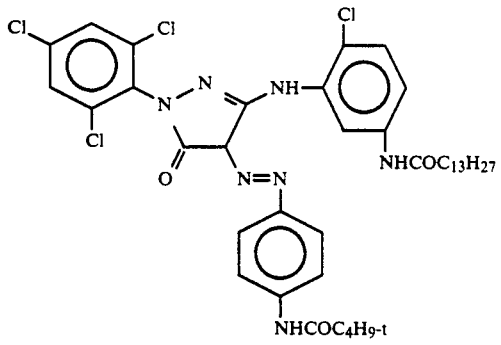
MM-3
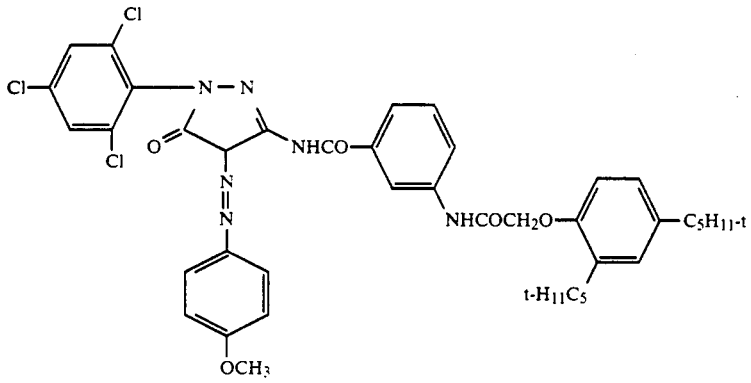
MM-4
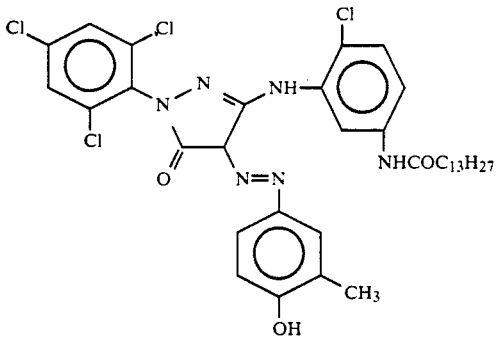
MM-5
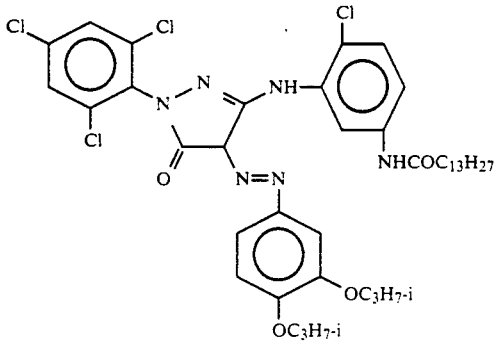
MM-6

-continued

MM-7

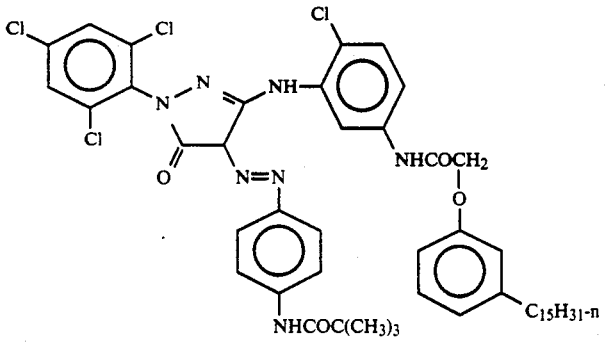

MM-8

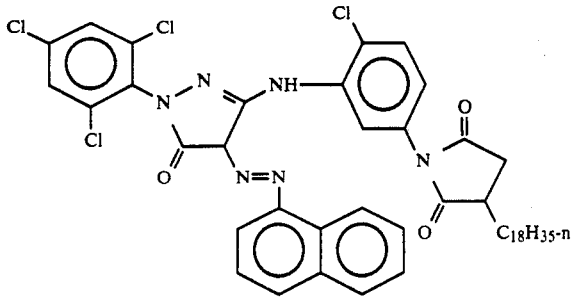

14. The element of claim 12 wherein all of said green sensitive layers contain said masking coupler.

15. The element of claim 14 wherein the content of said masking coupler in said layers is sufficient to provide a substantially linear response of the element to green light across the sensitivity range of the green sensitive layer.

16. A process for forming an image from an element as described in claim 1 after its exposure to light comprising contacting said exposed element with a color developing agent.

17. The process of claim 16 wherein the developing agent is a phenylene diamine.

* * * * *